US005632312A

United States Patent [19]

Hoffman

[11] Patent Number: 5,632,312

[45] Date of Patent: May 27, 1997

[54] TIE-WRAP TOOL WITH IMPROVED BRACING BLOCK

[75] Inventor: Richard A. Hoffman, Landenberg, Pa.

[73] Assignee: Dymetrol Company, Inc., Hockessin, Del.

[21] Appl. No.: 628,132

[22] Filed: Apr. 4, 1996

[51] Int. Cl.[6] ..... B21F 9/02

[52] U.S. Cl. ..... 140/123.6; 140/93.2; 24/DIG. 22

[58] Field of Search ..... 140/93.2, 93.4, 140/123.5, 123.6; 24/DIG. 22

[56] References Cited

U.S. PATENT DOCUMENTS

| | | | |
|---|---|---|---|
| 2,796,891 | 6/1957 | Mathewson | 140/93.4 |
| 4,688,607 | 8/1987 | Wolcott | 140/93.2 |
| 5,372,166 | 12/1994 | Lai . | |

*Primary Examiner*—Lowell A. Larson
*Attorney, Agent, or Firm*—Huntley & Associates

[57] ABSTRACT

A tie-wrap tool having an improved bracing block with increased gripping ability.

7 Claims, 2 Drawing Sheets

TIE-WRAP TOOL WITH IMPROVED BRACING BLOCK

BACKGROUND OF THE INVENTION

The present invention generally relates to a tie-wrap tool that can tighten and cut a tie-wrap in a single operation, and more specifically to a tie-wrap tool with an improved bracing block designed to more securely grip harder tie-wraps.

A tie-wrap is typically a plastic strip used with a tie-head or other device to fasten several parallel cables or wires together. Typically, the tie-wrap is inserted into a tie-head, wrapped around several cables or wires, and pulled through the tie-head A tie-wrap tool can then be used to tighten the tie-wrap around the cables or wires, and to cut the tie-wrap when the cables have been secured and the tie-wrap reaches a preset tightness.

Although there are many tie-wrap tools disclosed in the prior art, there has been no disclosure relating to the structure and configuration of a bracing block suitable for gripping a harder tie-wrap. For example, the tie-wrap tool disclosed in Lai et al, U.S. Pat. No. 5,372,166, while providing a means for tightening and cutting a tie-wrap with one tool in a single operation, thus allowing operation with one hand, fails to provide a specific means for designing a bracing block capable of gripping tie-wraps of increased tensile strength. While the Lai patent discloses a bracing block, preferably including a toothed surface, there is no disclosure of how to make a bracing block capable of gripping a harder tie-wrap. The several figures in the Lai patent also fail to reveal the structure of the teeth or where to position the teeth on the bracing block so that they can engage a tie-wrap.

Generally, there is a lack of any prior art specifically teaching a configuration and design for a bracing block capable of gripping harder straps. The gripping performance of the bracing blocks in prior devices is generally inversely related to the tensile strength of the straps, and because, in many applications, straps of higher tensile strength are desirable, there is a need for a bracing block capable of securely gripping straps of higher tensile strength.

SUMMARY OF THE INVENTION

The present invention satisfies the need for a bracing block capable of gripping even the hardest tie-wrap by providing an improved bracing block with teeth designed and positioned to engage and grip the tie-wrap.

Specifically, the present invention provides, in a tie-wrap tool adapted to grip and cut a tie-wrap, the tie-wrap tool comprising an actuating handle and a gripping handle pivotally secured together by a rear axle bolt and a torsion spring carried by the rear axle bolt for urging the handles apart, a feed-in hole at a forward portion of the actuating handle, a holding block secured to the actuating handle adjacent to the feed-in hole, the actuating handle having a pair of side panels, each side panel having an upper slotted hole and a lower slotted hole formed therein, a pair of guiding plates, a front axle bolt, a middle axle bolt, each guiding plate being movably mounted to a side panel of the actuating handle by the front and middle axle bolts extending through the upper slotted holes and the rear axle bolt extending through the lower slotted holes, a cutter blade secured to the front axle bolt, a tensioning spring having first and second ends, the first end being secured to the middle axle bolt and means securing the second end to the actuating handle at a rearward portion thereof, the gripping handle having side panels and including a feed-out hole at a forward portion thereof, at least one bracing block rotatably mounted adjacent to the feed-out hole about an axis between the side panels of the gripping handle, and a spring for rotating the bracing block toward the actuating handle and into engagement with a tie-wrap extending through the feed-out hole, the improvement wherein the bracing block comprises: (a) a single row of a plurality of teeth, each tooth comprising at least three triangular faces joined to form a pyramid with an apex defined by the intersection of the three triangular faces; (i) wherein the angle of each of the three triangular faces that form the apex of the pyramid is less than about 90°; (ii) wherein the row of teeth is positioned at a point on the perimeter of the bracing block farthest from the axis of rotation of the bracing block; and (iii) wherein the row of teeth is perpendicular to the length of a tie-wrap extending through the feed-out hole; (b) a notch formed in the bracing block; and (c) at least one restraining pin in the gripping handle positioned to engage the notch formed in the bracing block when, in the absence of a tie-wrap, the bracing block is biased towards the actuating handle, each restraining pin restricting the rotation of the bracing block to prevent the teeth from contacting the gripping handle.

DETAILED DESCRIPTION OF THE INVENTION

The apparatus of the present invention will be more fully understood by reference to the drawings. In these figures, like numbers refer to like elements. Although the drawings refer to specific embodiments of the tie-wrap tool and bracing block of the present invention, variations and modifications can be substituted without departing from the principles of the invention, as will be evident to those skilled in the art.

Although the drawings show an embodiment of a bracing block of the present invention adapted for use in a specific tie-wrap tool, the bracing block of the present invention can be modified for use in any tie-wrap tool utilizing a bracing block, pawl, or similar gripping means to engage a tie-wrap.

Figure 1:
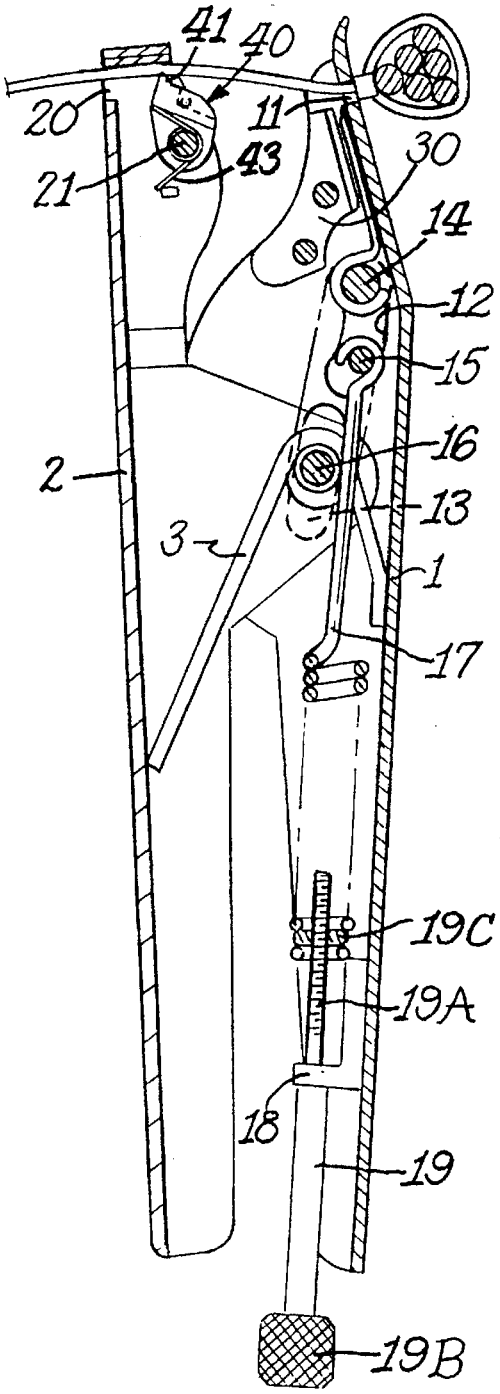
FIG. 1 is a cross-sectional view of a tie-wrap tool having a first embodiment of a bracing block of the present invention, wherein the forward end of each handle has been urged apart.
Figure 2:
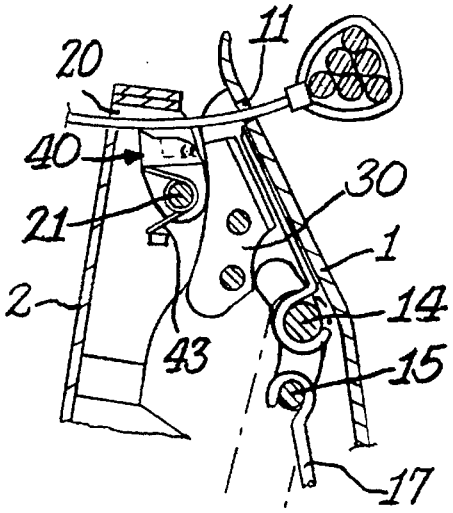
FIG. 2 is a fragmental cross-sectional view of a tie-wrap tool of FIG. 1, wherein the forward end of each handle has been urged together by a torsion spring.
Figure 3:
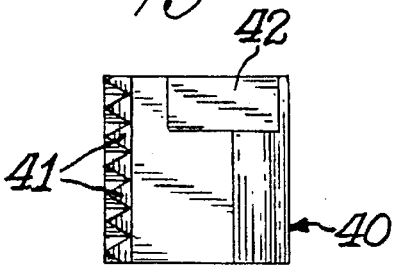
FIG. 3 is a top plan view of a second embodiment of a bracing block of the present invention.
Figure 4:
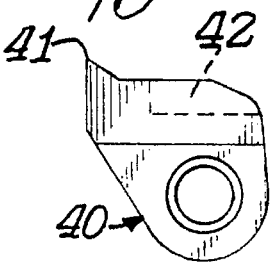
FIG. 4 is a side elevational view of the bracing block of FIG. 3.
Figure 5:
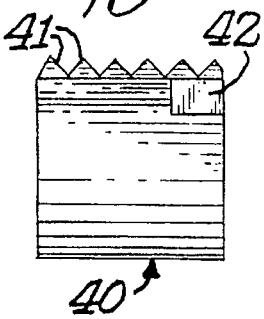
FIG. 5 is a rear elevational view of the bracing block of FIG. 3.
Figure 6:
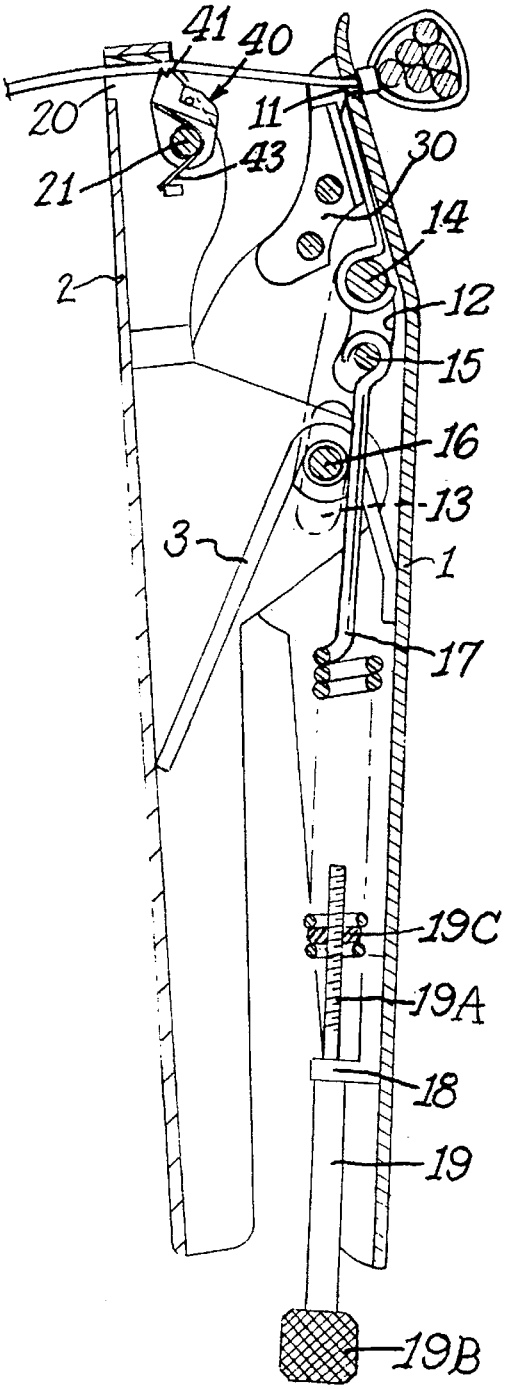
FIG. 6 is a cross-sectional view of a tie-wrap tool having a second embodiment of a bracing block of the present invention, wherein the forward end of each handle has been urged apart.
Figure 7:
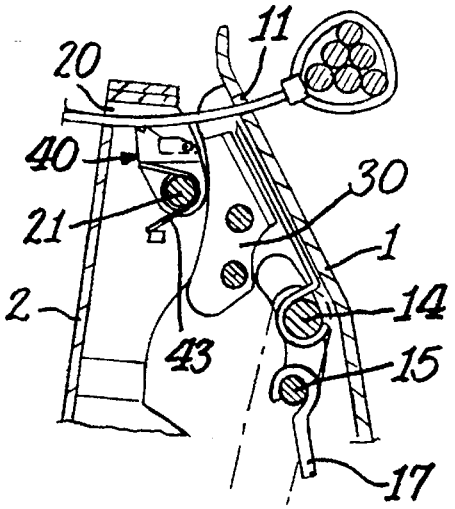
FIG. 7 is a fragmental cross-sectional view of a tie-wrap tool of FIG. 6, wherein the forward end of each handle has been urged together by a torsion spring.
Figure 8:
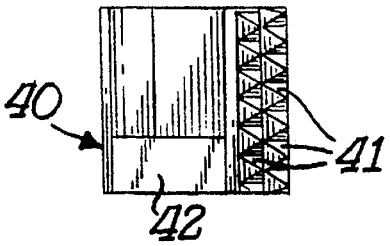
FIG. 8 is a top plan view of a second embodiment of a bracing block of the present invention.
Figure 9:
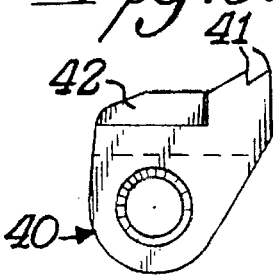
FIG. 9 is a side elevational view of the bracing block of FIG. 8.
Figure 10:
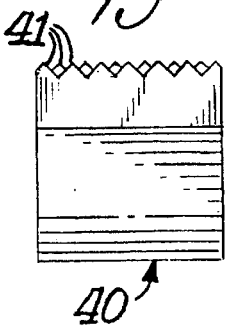
FIG. 10 is a rear elevational view of the bracing block of FIG. 8.

FIGS. 1 and 2 show a tie-wrap tool having a first embodiment of a bracing block of the present invention, and FIGS. 6 and 7 show a tie-wrap tool having a second embodiment of a bracing block of the present invention. In FIGS. 1 and 6 the forward ends of each handle of the tie-wrap tool have been urged apart, while in FIGS. 2 and 7 the forward ends of each handle have been urged together by a torsion spring. FIGS. 3, 4, and 5 show a first embodiment of a bracing block of the present invention corresponding to the bracing block of FIGS. 1 and 2. FIGS. 8, 9, and 10 show a second embodiment of a bracing block of the present invention corresponding to the bracing block of FIGS. 6 and 7.

In FIGS. 1, 2, 6, and 7 the tie-wrap tool has an actuating handle 1 and a gripping handle 2 pivotally secured together by a rear axle bolt 16 and biased by a torsion spring 3. Each handle has a forward and rearward end, and the handles are secured near their mid-sections, so that when the forward ends are together, the rearward ends are apart. A feed-in hole 11 in the forward end of the actuating handle and a feed-out hole 20 in the forward end of the gripping handle, both positioned to accept and engage a tie-wrap.

The actuating handle has comprises side panels and has two long slotted holes 12 and 13 which are arranged in upper and lower positions adjacent to each other in the two side panels of the gripping handle. A holding block 30 is mounted between the side panels of the actuating handle facing the gripping handle and adjacent to the upper slotted hole. Three axle bolts 14, 15 and 16 are used to movably mount a guiding block on each side panel. The front and middle axle bolts, 14 and 15 respectively, secure the guiding plates to each other through the upper slotted hole, and the rear axle bolt 16 secures the guiding plates together through the lower slotted hole. The front axle bolt also positions and secures a cutting blade between the side panels of the actuating handle, and the resulting assembly is moveable to the extent the axle bolts can move within the upper and lower slotted holes.

A tension spring 17 is connected to the middle axle bolt at its upper end. A positioning block 18 on the inside of the rearward end of the actuating handle has a hole adapted for insertion of an adjustment screw rod 19 having a handle at its lower end 19A and being threaded at its upper end 19B. The threaded end of the adjustment screw rod is connected to the lower end of the tension spring and secured by a nut 19C, thus securing the lower end of the tension spring to the actuating handle. As the adjustment screw rod is rotated, the threaded end causes the nut to move, thus tightening or loosening the tension spring. The tension spring can thus be adjusted to be activated at a desired pressure, so that the tie-wrap will be cut once it has tightly bound the cables or wires to be fastened.

The forward end of the gripping handle has side panels through which an axle bolt 21 rotatably secures a bracing block of the present invention 40. The bracing block has teeth 41 and a notch 42 formed therein, and a restraining pin 22 mounted on the inside of a side panel of the gripping handle is positioned to engage the notch. The bracing block is rotationally biased towards the actuating handle by a spring 43, which is also secured by the axle bolt. The rotation of the bracing block is limited by the restraining pin engaging the notch formed in the bracing block, thus preventing the teeth on the bracing block from contacting the gripping handle or the holding block. When the forward ends of the gripping handle and actuating handle are urged together, the forward end of the bracing block contacts the holding block in the actuating handle, urging the bracing block away from the actuating handle. As the contact with the holding block causes the bracing block to rotate away from the actuating handle, a gap is created between the teeth on the bracing block and the gripping handle surrounding the feed-out hole sufficient in size to allow a tie-wrap to extend from the feed-in hole and through the feed-out hole without being engaged by the bracing block. When the forward ends of the gripping and actuating handles are urged apart, the contact between the holding block and the bracing block is broken, and the bracing block is urged by the spring to rotate towards the actuating handle until engaging the tie-wrap extending from the feed-in hole through the feed-out hole.

Typically, to use the tie-wrap tool, one end of a tie-wrap extending around the items to be fastened is fed into the feed-in hole and pulled out the feed-out hole. The rearward ends of the handles of the tie-wrap tool are urged together by an operator, causing the bracing block to engage the tie-wrap, which pulls the end of the tie-wrap away from the actuating handle, thus tightening the tie-wrap. When the items to be fastened are secured, by a level of pressure selected by adjusting the adjustment screw rod, the cutting blade is activated when the rearward ends of the handles are urged apart, and the tie-wrap is cut at the desired position, thus securing the items to be fastened.

In FIGS. 3, 4, and 5 a first embodiment of a bracing block of the present invention is shown having a single row of a plurality of pyramid shaped teeth. In this embodiment the teeth shown have four triangular faces forming a quadrilateral pyramid. The row of teeth is parallel to the axis of rotation of the bracing block and positioned farthest from the axis of rotation of the block, at the upper end of the rear of the block.

In FIGS. 8, 9, and 10 a second embodiment of a bracing block of the present invention is shown having a first and second row of a plurality of pyramid shaped teeth. In this embodiment, the teeth shown also have four triangular faces forming a quadrilateral pyramid. The first and second rows of teeth are parallel to each other, and to the axis of rotation of the bracing block. The second row is positioned farthest from the axis of rotation, while the first row is closer to the axis of rotation, so that when the bracing block is biased into engagement with a tie-wrap extending through the feed-out hole, the second row of teeth engages the tie-wrap before the first row. The teeth in the second row are offset from those in the first row, so that the tips of the teeth in one row are aligned with the valleys between the teeth in the other row.

The bracing block of the present invention can be utilized in a wide variety of tie-wrap tools, and, if modified in accordance with the principles of this invention, the bracing block of the present invention can be used in any tie-wrap tool utilizing a bracing block, pawl, or other gripping means. In addition, the bracing block of the present invention can be utilized in a tie-wrap tool having two bracing blocks, opposably mounted and biased, to simultaneously grip a tie-wrap on opposite sides. In such a tie-wrap tool, a first bracing block can be rotatably secured between the side panels of the forward end of the gripping handle above the feed-out hole, with the teeth facing the rearward end of the gripping handle. The second bracing block can be rotatably secured between the side panels of the gripping handle below the feed-out hole, with the teeth facing the teeth on the first bracing block. Each bracing block is biased towards the holding block in the actuating handle by a separate spring. When the forward end of each handle is urged apart, each bracing block is urged to rotate towards the other by each spring. Accordingly, when the forward ends of each handle are urged apart, each bracing block rotates into contact with an opposite side of a tie-wrap extending through the feed-out hole, and when the forward ends of each handle are urged together, each bracing block is urged to rotate away from engagement with the tie-wrap as they are contacted by the holding block in the actuating handle.

The improved bracing block of the present invention provides a desirable combination of advantages. The position of the teeth at the farthest point from the axis of rotation of the bracing block provides maximum leverage for gripping the tie-wrap, while the configuration of the teeth provides an effective gripping means for harder tie-wraps that is also suitable for softer tie-wraps.

Specifically, the pyramidal configuration of each tooth, and the angle defining each face of the point of the tooth, provide a plurality of sharp points with which to grip a tie-wrap. The teeth are kept sharp as a result of the restraining pin limiting the rotation of the bracing block so that the teeth do not contact the gripping handle. As a result of the fact that the teeth cannot contact the gripping handle, a spring of increased strength can be used without causing the teeth to become dulled, a problem in prior tie-wrap tools lacking a restraining pin. Because of the preferred height limitations of the teeth, a bracing block can be created to engage a tie-wrap of specific thickness without violating the integrity of the tie-wrap by digging more than halfway through the tie-wrap.

In an alternate embodiment wherein the bracing block comprises two parallel rows of pyramid shaped teeth, each row being offset from the other so that the tips of the teeth in one row are aligned with the valleys between the teeth in the other row, the gripping capabilities of the bracing block are further increased. As the first row of teeth engages the tie-wrap, digging deeper into the tie-wrap, the second row of teeth begins to engage the tie-wrap at alternate positions on the tie-wrap. This provides more points of contact for gripping the tie-wrap, and the design limitations of the teeth prevents the first row of teeth from digging so far into the tie-wrap as to reduce its strength and integrity.

In all of the embodiments of the bracing block of the present invention, at least one restraining pin prevents the teeth from becoming dull through repeated contact with the portion of the gripping handle adjacent the feed-out hole. Because the teeth are prevented from becoming dull by contact with the gripping handle, a restraining pin permits the use of a stronger spring for urging the bracing block into engagement with a tie-wrap. In addition, the restraining pin enables the bracing block of the present invention to be configured with the teeth farthest from the axis of rotation; without a restraining pin, the bracing block would be able to rotate 360° and would not remain in a biased position ready to engage a tie-wrap.

I claim:

1. In a tie-wrap tool adapted to grip and cut a tie-wrap, the tie-wrap tool comprising an actuating handle and a gripping handle pivotally secured together by a rear axle bolt and a torsion spring carried by the rear axle bolt for urging the handles apart, a feed-in hole at a forward portion of the actuating handle, a holding block secured to the actuating handle adjacent to the feed-in hole, the actuating handle having a pair of side panels, each side panel having an upper slotted hole and a lower slotted hole formed therein, a pair of guiding plates, a front axle bolt, a middle axle bolt, each guiding plate being movably mounted to a side panel of the actuating handle by the front and middle axle bolts extending through the upper slotted holes and the rear axle bolt extending through the lower slotted holes, a cutter blade secured to the front axle bolt, a tensioning spring having first and second ends, the first end being secured to the middle axle bolt and means securing the second end to the actuating handle at a rearward portion thereof, the gripping handle having side panels and including a feed-out hole at a forward portion thereof, at least one bracing block rotatably mounted adjacent to the feed-out hole about an axis between the side panels of the gripping handle, and a spring for rotating the bracing block toward the actuating handle and into engagement with a tie-wrap extending through the feed-out hole, the improvement wherein the bracing block comprises:

(a) a single row of a plurality of teeth, each tooth comprising at least three triangular faces joined to form a pyramid with an apex defined by the intersection of the three triangular faces;

(i) wherein the angle of each of the three triangular faces that form the apex of the pyramid is less than about 90°;

(ii) wherein the row of teeth is positioned at a point on the perimeter of the bracing block farthest from the axis of rotation of the bracing block; and (iii) wherein the row of teeth is perpendicular to the length of a tie-wrap extending through the feed-out hole;

(b) a notch formed in the bracing block; and (c) at least one restraining pin in the gripping handle positioned to engage the notch formed in the bracing block when, in the absence of a tie-wrap, the bracing block is biased towards the actuating handle, each restraining pin restricting the rotation of the bracing block to prevent the teeth from contacting the gripping handle.

2. A tie-wrap tool of claim 1 further adapted to grip and cut a tie-wrap of predetermined thickness wherein the height of each tooth is less than about half of the thickness of the tie-wrap.

3. A tie-wrap tool of claim 1 wherein each tooth comprises four triangular faces joined to form a quadrilateral pyramid with an apex defined by the point of intersection of the four triangular faces.

4. A tie-wrap tool of claim 1 further comprising a second row of pyramid shaped teeth parallel to the first row and positioned closer to the axis of rotation of the bracing block than the first row of teeth.

5. A tie-wrap of claim 4 wherein the teeth in the second row are offset from the teeth in the first row.

6. A tie-wrap tool of claim 1 having first and second opposably mounted bracing blocks positioned to simultaneously engage opposite sides of a tie-wrap extending through the feed-out hole.

7. A tie-wrap tool of claim 6 wherein the teeth on the first bracing block are offset from the teeth on the second bracing block.

* * * * *